US012502617B2

(12) United States Patent
Qiu

(10) Patent No.: US 12,502,617 B2
(45) Date of Patent: Dec. 23, 2025

(54) POLYHEDRAL MAGNETIC TOY BRICK AND COMBINED STRUCTURE

(71) Applicant: Xinyu Qiu, Taiyuan (CN)

(72) Inventor: Xinyu Qiu, Taiyuan (CN)

( * ) Notice: Subject to any disclaimer, the term of this patent is extended or adjusted under 35 U.S.C. 154(b) by 320 days.

(21) Appl. No.: 18/319,751

(22) Filed: May 18, 2023

(65) Prior Publication Data

US 2023/0285869 A1 Sep. 14, 2023

(30) Foreign Application Priority Data

Nov. 1, 2022 (CN) ..... 202222907226.2

(51) Int. Cl.

| | |
|---|---|
| ***A63H 3/04*** | (2006.01) |
| ***A63H 33/04*** | (2006.01) |
| ***A63H 33/08*** | (2006.01) |
| ***A63H 33/26*** | (2006.01) |

(52) U.S. Cl.
CPC ..... *A63H 33/046* (2013.01); *A63H 33/088* (2013.01); *A63H 33/26* (2013.01)

(58) Field of Classification Search
CPC ..... A63H 33/046; A63H 33/26
See application file for complete search history.

(56) References Cited

U.S. PATENT DOCUMENTS

| | | | | |
|---|---|---|---|---|
| 5,009,625 | A * | 4/1991 | Longuet-Higgins | A63H 33/046 446/85 |
| 5,651,715 | A * | 7/1997 | Shedelbower | A63F 9/088 446/490 |
| 10,857,475 | B2 * | 12/2020 | Moskowitz | A63H 33/108 |
| 10,918,964 | B2 * | 2/2021 | Hoenigschmid | A63H 33/046 |
| 2006/0046605 | A1 * | 3/2006 | Piretti | A63H 33/086 446/122 |
| 2010/0095953 | A1 | 4/2010 | Husted et al. | |
| 2014/0256210 | A1 * | 9/2014 | Johnson | A63H 33/046 446/108 |
| 2016/0368824 | A1 | 12/2016 | Miyao et al. | |
| 2019/0359433 | A1 | 11/2019 | Yang et al. | |
| 2021/0204721 | A1 * | 7/2021 | Srikanchana | A63G 31/00 |

* cited by examiner

*Primary Examiner* — John A Ricci
(74) *Attorney, Agent, or Firm* — Zhigang Ma

(57) ABSTRACT

The present disclosure discloses a polyhedral magnetic toy brick and a combined structure. A polyhedral magnetic toy brick includes an inner-layer assembly, at least two magnets and an outer skin assembly. The inner-layer assembly includes several board bodies folded to form the inner-layer assembly. The board bodies include at least one triangular magnetic face; two magnet mounting holes are formed in the magnetic face. One magnet is mounted in each magnet mounting hole, and the two magnets on the same magnetic face have opposite outward magnetisms. The outer skin assembly wraps an outer surface of the inner-layer assembly, so that the magnets can be stably fixed on the board body and is avoided from being separated or moving relative to the board body, the board bodies with different shapes are connected, and are combined stably. Meanwhile, the possibility and diversification of constructing models are further achieved.

18 Claims, 13 Drawing Sheets

POLYHEDRAL MAGNETIC TOY BRICK AND COMBINED STRUCTURE

CROSS-REFERENCE TO RELATED APPLICATIONS

The application claims priority of Chinese patent application CN2022229072262, filed on 2022 Nov. 1, which is incorporated herein by reference in its entireties.

TECHNICAL FIELD

The present disclosure relates to the field of magnetic toy bricks, and more particularly to, a polyhedral magnetic toy brick and a combined structure.

BACKGROUND

Toy bricks are a common educational toy. Various shapes are individual basic elements, and the elements can be combined into multiple different shapes in specific ways. Combination methods include plugging, magnetic attraction, and the like. For magnetic toy bricks, N-pole and S-pole magnets attract each other, to achieve construction of two toy bricks. For example, the invention patent No. CN2019217830934 and entitled "a magnetic toy brick combination", in which a toy brick is composed of a cloth outer skin, a sponge body filling the cloth outer skin, and a magnet arranged between the cloth outer skin and the sponge body. Furthermore, an outward face of the magnet on at least one face of the toy brick is an N pole, and an outward face of the magnet on at least one face of the toy brick is an S pole; and the outward magnetisms of the magnets on the same faces of the toy bricks are consistent, so that two toy bricks are combined by magnetic attraction between one face and another face.

The magnet in the above patent is adhered to the sponge body, so that the magnet is easily separated from the sponge body, and moves. As a result, a combined model is unstable and would even topple over. In addition, in the toy brick structure of the aforementioned patent, the outward magnetisms of the magnets on the same face are the same, to ensure that the faces of the two toy bricks are aligned. A first toy brick and a second toy brick are taken as an example. The first toy brick and the second toy brick each have four faces, two of which are N-pole faces with outward magnetisms of N poles and the other two of which are S-pole faces with outward magnetisms of S poles. It can be seen that the first toy brick only has two N-pole faces connected to the S-pole faces of the second toy brick, that is, the N-pole faces of the first toy brick cannot be connected to the N-pole faces of the second toy brick, and the S-pole faces of the first toy brick cannot be connected to the S-pole faces of the second toy brick, so that the possibility and degree of freedom of constructing models are restrained.

SUMMARY

In order to solve the above problems, the present disclosure provides a polyhedral magnetic toy brick which are stable and reliable in structure and can increase the possibility of constructing models, and a combined structure.

According to one purpose of the present disclosure, the present disclosure discloses a polyhedral magnetic toy brick including an inner-layer assembly, wherein the inner-layer assembly includes several board bodies; the several board bodies are folded to form the inner-layer assembly; the board bodies includes at least one triangular magnetic face; two magnet mounting holes are formed in the magnetic face; at least two magnets, wherein one magnet is mounted in each magnet mounting hole, and the two magnets on the same magnetic face have opposite outward magnetisms; and an outer skin assembly, wherein the outer skin assembly wraps an outer surface of the inner-layer assembly.

As a preferred embodiment, the magnetic faces are outer faces of the board bodies; when there is one magnetic face, the board body defined by the magnetic face is triangular; and when there are two magnetic faces, the board body defined by the two magnetic faces is rhombic or square.

As a preferred embodiment, the two magnets are symmetrically arranged along a center line of the triangular magnetic face.

As a preferred embodiment, each polyhedral magnetic toy brick is a tetrapyramid including five board bodies, namely, a first board body, a second board body, a third board body, a fourth board body, and a fifth board body; the first board body is rhombic; the second board body, the third board body, the fourth board body, and the fifth board body are triangular; the second board body and the fourth board body are rotatably connected to two opposite edges of the first board body; the third board body and the fifth board body are plugged to the other two opposite edges of the first board body; the third board body and the second board body, as well as the fourth board body and the fifth board body, are rotatably connected; and the second board body and the fifth board body, as well as the third board body and the fourth board body, are plugged.

As a preferred embodiment, each polyhedral magnetic toy brick is a triangular pyramid including four board bodies, namely, a first board body, a second board body, a third board body, a fourth board body, and a fifth board body; the first board body, the second board body, the third board body, and the fourth board body are triangular; the second board body and the fourth board body are rotatably connected to two edges of the first board body; the third board body is plugged to the other edge of the first board body; the third board body and the fourth board body are rotatably connected; and the second board body and the fourth board body, as well as the third board body and the second board body, are plugged.

As a preferred embodiment, each polyhedral magnetic toy brick is an oblique quadrangular prism including sixth board bodies, namely, a first board body, a second board body, a third board body, a fourth board body, a fifth board body, and a sixth board body; the first board body, the second board body, the third board body, the fourth board body, the fifth board body, and the six board body are rhombic; the third board body and the sixth board body are rotatably connected to two adjacent edges of the first board body; the fourth board body and the fifth board body are plugged to the other two adjacent edges of the first board body; the third board body and the sixth board body, as well as the fourth board body and the fifth board body are plugged; the second board body and the first board body are parallel; the second board body and the fifth board body are rotatably connected; and the second board body and the third board body, as well as the fourth board body and the sixth board body are plugged.

As a preferred embodiment, each polyhedral magnetic toy brick is an oblique triangular prism including five board bodies, namely, a first board body, a second board body, a third board body, a fourth board body, and a fifth board body; the first board body, the second board body, and the fourth board body are rhombic; the third board body and the fifth board body are triangular; the second board body and the fourth board body are rotatably connected to two opposite edges of the first board body; the fifth board body and the third board body are plugged to the other two opposite edges of the first board body; the fifth board body and the second board body, as well as the third board body and the fourth board body, are rotatably connected; and the fourth board body and the fifth board body, the third board body and the second board body, as well as the second board body and the fourth board body, are plugged.

As a preferred embodiment, each polyhedral magnetic toy brick is a rhombic regular dodecahedron; the inner-layer assembly is formed by connecting two groups of the board bodies; there are six board bodies in each group, namely, a first board body, a second board body, a third board body, a fourth board body, a fifth board body, and a sixth board body; the first board body, the second board body, the third board body, the fourth board body, the fifth board body, and the sixth board body are rhombic; two adjacent edges of the first board body are respectively plugged to the third board body and the fifth board body; another edge of the first board body is rotatably connected with the second board body; the second board body and the third board body are rotatably connected; the fourth board body is rotatably connected between the third board body and the fifth board body; the sixth board body and the fifth board body are rotatably connected; and the sixth board body and the fourth board body are plugged.

As a preferred embodiment, the several board bodies are integrally molded, and are folded and fixed by plugging.

According to another purpose of the present disclosure, the present disclosure also discloses a combined structure including two polyhedral magnetic toy bricks, each of the polyhedral magnetic toy bricks including: an inner-layer assembly, wherein the inner-layer assembly includes several board bodies; the several board bodies are folded to form the inner-layer assembly; the board bodies include at least one triangular magnetic face; two magnet mounting holes are formed in the magnetic face; at least two magnets, wherein one magnet is mounted in each magnet mounting hole, and the two magnets on the same magnetic face have opposite outward magnetisms; and an outer skin assembly, wherein the outer skin assembly wraps an outer surface of the inner-layer assembly, wherein two of the polyhedral magnetic toy bricks are connected through the magnetic faces.

As a preferred embodiment, the magnetic faces are outer faces of the board bodies; when there is one magnetic face, the board body defined by the magnetic face is triangular; and when there are two magnetic faces, the board body defined by the two magnetic faces is rhombic or square.

As a preferred embodiment, the two magnets are symmetrically arranged along a center line of the triangular magnetic face.

As a preferred embodiment, each polyhedral magnetic toy brick is a tetrapyramid including five board bodies, namely, a first board body, a second board body, a third board body, a fourth board body, and a fifth board body; the first board body is rhombic; the second board body, the third board body, the fourth board body, and the fifth board body are triangular; the second board body and the fourth board body are rotatably connected to two opposite edges of the first board body; the third board body and the fifth board body are plugged to the other two opposite edges of the first board body; the third board body and the second board body, as well as the fourth board body and the fifth board body, are rotatably connected; and the second board body and the fifth board body, as well as the third board body and the fourth board body, are plugged.

As a preferred embodiment, each polyhedral magnetic toy brick is a triangular pyramid including four board bodies, namely, a first board body, a second board body, a third board body, a fourth board body, and a fifth board body; the first board body, the second board body, the third board body, and the fourth board body are triangular; the second board body and the fourth board body are rotatably connected to two edges of the first board body; the third board body is plugged to the other edge of the first board body; the third board body and the fourth board body are rotatably connected; and the second board body and the fourth board body, as well as the third board body and the second board body, are plugged.

As a preferred embodiment, each polyhedral magnetic toy brick is an oblique quadrangular prism including sixth board bodies, namely, a first board body, a second board body, a third board body, a fourth board body, a fifth board body, and a sixth board body; the first board body, the second board body, the third board body, the fourth board body, the fifth board body, and the six board body are rhombic; the third board body and the sixth board body are rotatably connected to two adjacent edges of the first board body; the fourth board body and the fifth board body are plugged to the other two adjacent edges of the first board body; the third board body and the sixth board body, as well as the fourth board body and the fifth board body are plugged; the second board body and the first board body are parallel; the second board body and the fifth board body are rotatably connected; and the second board body and the third board body, as well as the fourth board body and the sixth board body are plugged.

As a preferred embodiment, each polyhedral magnetic toy brick is an oblique triangular prism including five board bodies, namely, a first board body, a second board body, a third board body, a fourth board body, and a fifth board body; the first board body, the second board body, and the fourth board body are rhombic; the third board body and the fifth board body are triangular; the second board body and the fourth board body are rotatably connected to two opposite edges of the first board body; the fifth board body and the third board body are plugged to the other two opposite edges of the first board body; the fifth board body and the second board body, as well as the third board body and the fourth board body, are rotatably connected; and the fourth board body and the fifth board body, the third board body and the second board body, as well as the second board body and the fourth board body, are plugged.

As a preferred embodiment, each polyhedral magnetic toy brick is a rhombic regular dodecahedron; the inner-layer assembly is formed by connecting two groups of the board bodies; there are six board bodies in each group, namely, a first board body, a second board body, a third board body, a fourth board body, a fifth board body, and a sixth board body; the first board body, the second board body, the third board body, the fourth board body, the fifth board body, and the sixth board body are rhombic; two adjacent edges of the first board body are respectively plugged to the third board body and the fifth board body; another edge of the first board body is rotatably connected with the second board body; the second board body and the third board body are rotatably connected; the fourth board body is rotatably connected between the third board body and the fifth board body; the sixth board body and the fifth board body are rotatably connected; and the sixth board body and the fourth board body are plugged.

As a preferred embodiment, the several board bodies are integrally molded, and are folded and fixed by plugging.

Compared with the prior art, this technical solution has the following advantages:

The inner-layer assembly is formed by splicing the several board bodies, and the outer skin assembly wraps the outer surface of the inner-layer assembly, so that the polyhedral magnetic toy brick with good structural strength and stability can be formed. Furthermore, the magnet mounting holes for accommodating the magnets are formed in the magnetic face of the board body, so that the magnets can be stably fixed on the board body and is avoided from being separated or moving and even toppling over relative to the board body, and magnetic connection between the toy bricks can be guaranteed; and different models can be combined.

The same magnetic face has two magnets with opposite outward magnetisms. In this way, when two toy bricks are connected, the N-pole magnet on one magnetic face is in magnetic fit with the S-pole magnet on the other magnetic face, that is, the two magnetic faces are magnetically connected through the two groups of N and S-pole magnets, which ensures that the vertexes, the edges, and the faces of the two magnetic faces are kept in completely overlapping under the magnetic action, so that inconvenience in modeling and combination processes caused by turning, sliding, or other phenomena in a combination process is avoided. The board bodies with different shapes are connected, and are combined stably. Meanwhile, the possibility and diversification of constructing models are further achieved. For toy bricks provided with the magnets having the same magnetisms on each face, two toy bricks of the present disclosure can be combined through any magnetic face, which improves the degree of freedom of combination and the diversity of models.

In addition, the board bodies constituting the inner-layer assembly can be integrally molded and are then plugged. It can reduces the assembling difficulty and ensures the manufacturability.

The present disclosure is further described below in detail in combination with the accompanying drawings and embodiments.

DETAILED DESCRIPTION OF THE EMBODIMENTS

Figure 1:
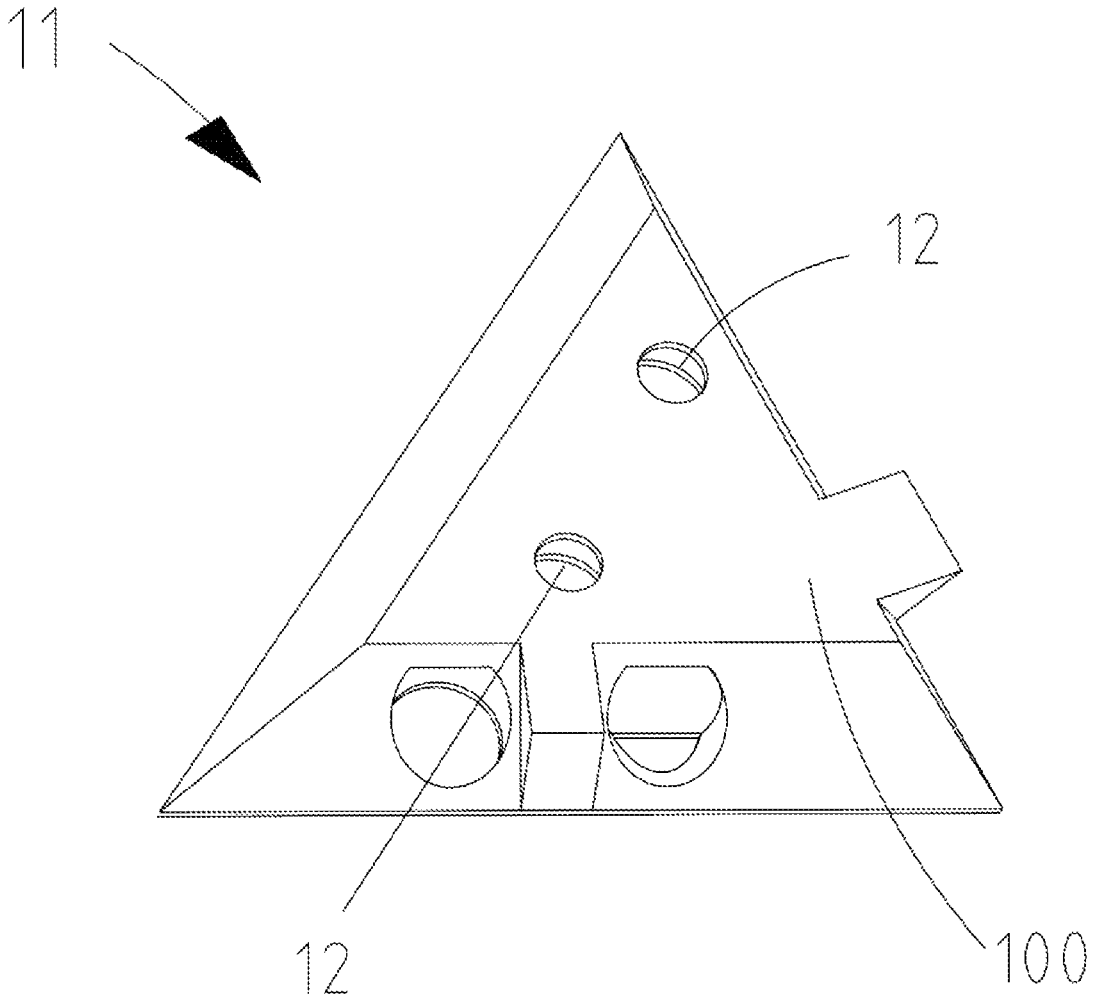
FIG. 1 is a schematic structural diagram of a first embodiment of board bodies of the present disclosure.

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

As shown in FIG. 1 to FIG. 8, polyhedral magnetic toy bricks each include:

- an inner-layer assembly 10, wherein the inner-layer assembly 10 includes several board bodies 11; the several board bodies 11 are folded to form the inner-layer assembly 10; the board bodies 11 include at least one triangular magnetic face 100; two magnet mounting holes 12 are formed in the magnetic face 100;
- at least two magnets 20, wherein one magnet 20 is mounted in each magnet mounting hole 12, and the two magnets 20 on the same magnetic face 100 have opposite outward magnetisms; and
- an outer skin assembly, wherein the outer skin assembly wraps an outer surface of the inner-layer assembly 10.

The inner-layer assembly 10 is formed by splicing the several board bodies 11, and the outer skin assembly wraps the outer surface of the inner-layer assembly 10, so that the polyhedral magnetic toy brick with good structural strength and stability can be formed. Furthermore, the magnet mounting holes 12 for accommodating the magnets 20 are formed in the magnetic face 100 of the board body 11, so that the magnets 20 can be stably fixed on the board body 11 and is avoided from being separated or moving and even toppling over relative to the board body 11, and magnetic connection between the toy bricks can be guaranteed; and different models can be combined. In addition, the same magnetic face 100 has two magnets 20 with opposite outward magnetisms. In this way, when two toy bricks are connected, the N-pole magnet on one magnetic face 100 is in magnetic fit with the S-pole magnet on the other magnetic face 100, that is, the two magnetic faces 100 are magnetically connected through the two groups of N and S-pole magnets, which ensures that the vertexes, the edges, and the faces of the two magnetic faces 100 are kept in completely overlapping under the magnetic action, so that inconvenience in modeling and combination processes caused by turning, sliding, or other phenomena in a combination process is avoided. Meanwhile, for traditional toy bricks provided with the magnets having the same magnetisms on each face, two toy bricks of the present disclosure can be combined through any magnetic face 100, which improves the degree of freedom of combination and the diversity of models.

Figure 3:
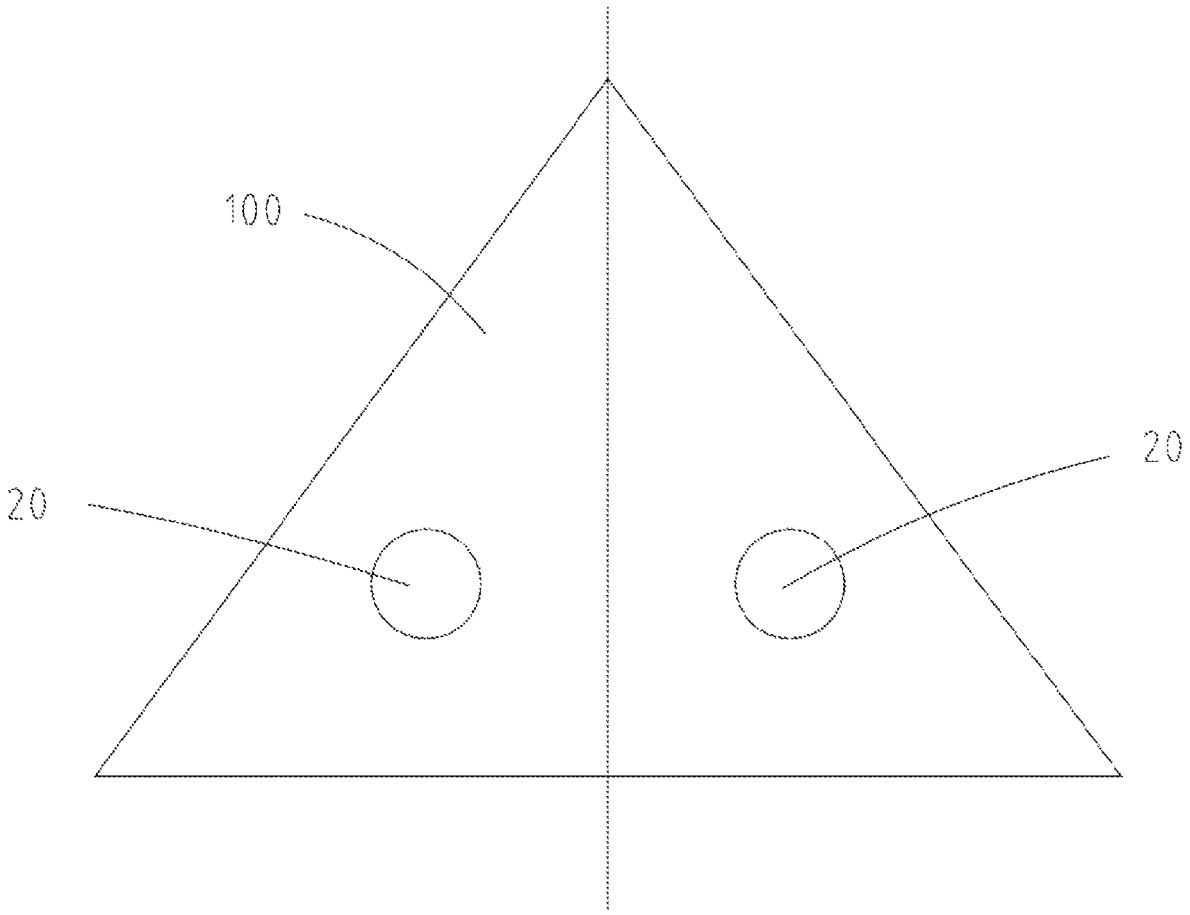
FIG. 3 is a schematic structural diagram of a magnetic face of the present disclosure.

As shown in FIG. 3, the magnetic face 100 may be an isosceles triangle, and the two magnets 20 are symmetrically arranged along a center line of the triangular magnetic face 100. The N pole of the magnet 20 on the left side is outward, and the S pole of the magnet 20 on the right side is outward, so that the outward magnetisms of the two magnets 20 are opposite. The magnets 20 may be circular.

The board bodies 11 and the outer skin assembly may be made of resin, for example, an Acrylonitrile Butadiene Styrene (ABS) resin material, so that after the outer skin assembly wraps the outer surface of the inner-layer assembly 10, the magnetisms of the magnets 20 will not be affected. The outer skin assembly includes at least two outer skins. The two outer skins wrap the outer surface of the inner-layer assembly, and are sutured by ultrasonic waves to ensure the connection strength between the outer skins. It should be noted that a shape of the polyhedral magnetic toy brick depends on the inner-layer assembly 10. The outer skin assembly wraps the outer surface of the inner-layer assembly 10, so that the polyhedral magnetic toy brick defined by the shape of the inner-layer assembly 10.

The magnet mounting holes 12 may be formed in an outer surface of each board body 11. The magnets 20 may be fixed in the magnet mounting holes 12 in an embedding, step clamping, adhesion, or combination manner, to ensure that the magnets 20 are stably fixed on the board body 11.

Figure 2:
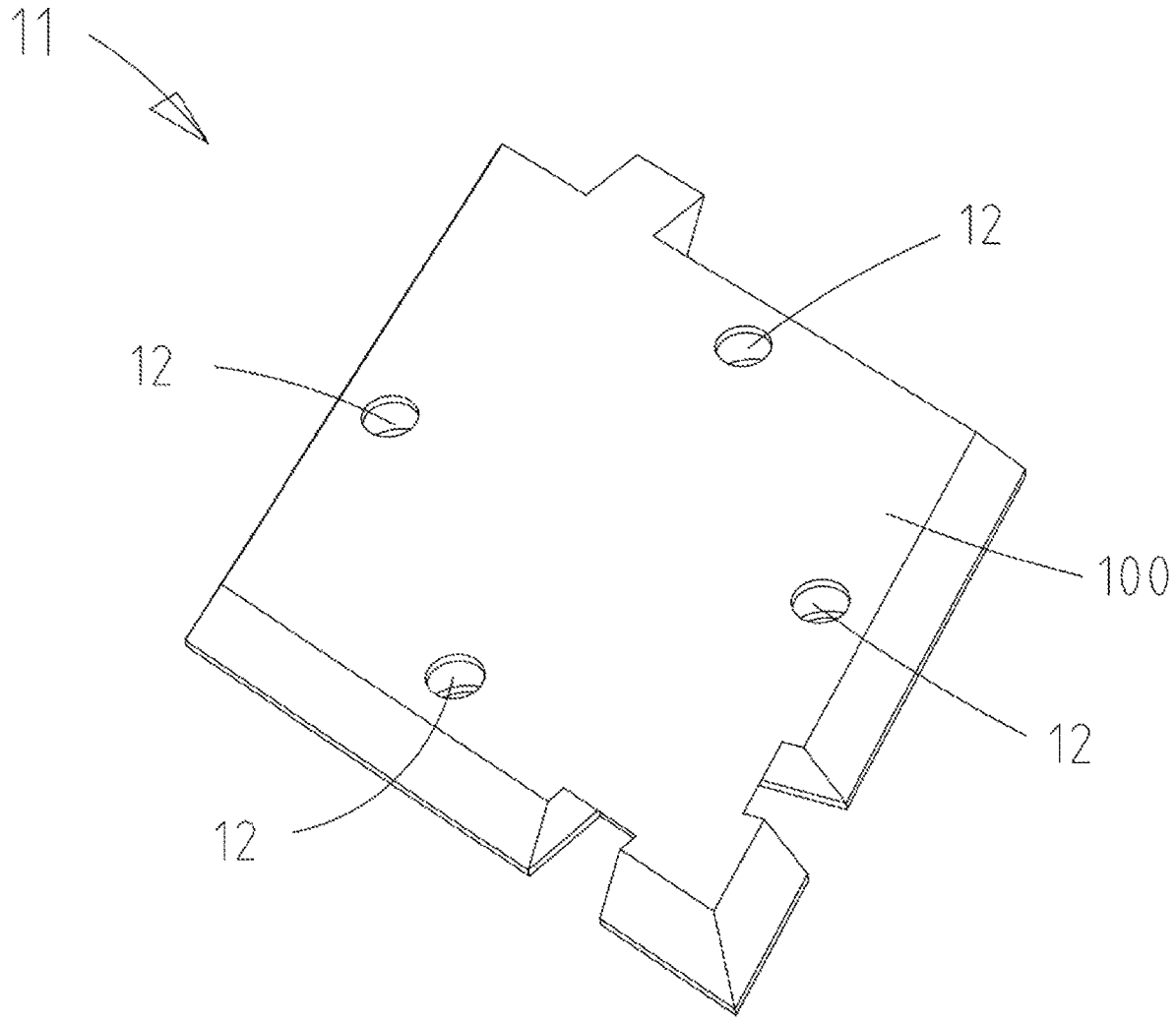
FIG. 2 is a schematic structural diagram of a second embodiment of board bodies of the present disclosure.

Referring to FIG. 1, the board body 11 is triangular. At this time, the board body 11 has one magnetic face 100. Referring to FIG. 2, the board body 11 is rhombic. At this time, the board body 11 has two magnetic faces 100. That is, the rhombus is composed of two triangles separately corresponding to the two magnetic faces 100. Of course, the board body 11 may also be square. At this time, the board body 11 also has two magnetic faces 100.

It should be noted that the outward magnetisms of the magnets of each board body in the prior are the same, while each magnetic face 100 of the present disclosure is provided with the two magnets 20 with opposite outward magnetisms to connect the board bodies 11 with different shapes. For example, one board body 11 is triangular, and the other board body 11 is rhombic. Due to the two magnets 20 with the opposite outward magnetisms on the magnetic faces 100, the triangular board body 11 can be magnetically connected to the magnetic face 100 of one triangle of the rhombic board body 11. Furthermore, the two magnetic faces 100 are aligned. It can be seen that the board bodies 11 with different shapes are formed by taking the magnetic faces 100 as units, so that the board bodies 11 with different shapes are connected, to increase the possibility of constructing models. It is worth mentioning that the outward magnetisms of the magnets of each board body are the same in the prior art. When two board bodies with different shapes are combined, the smaller board body cannot be constructed at a specified position of the larger board body, which will affect the experience of construction.

The polyhedral magnetic toy brick may be a regular dodecahedron or a polyprism, which will be described below by five embodiments:

First Embodiment

Figure 4:
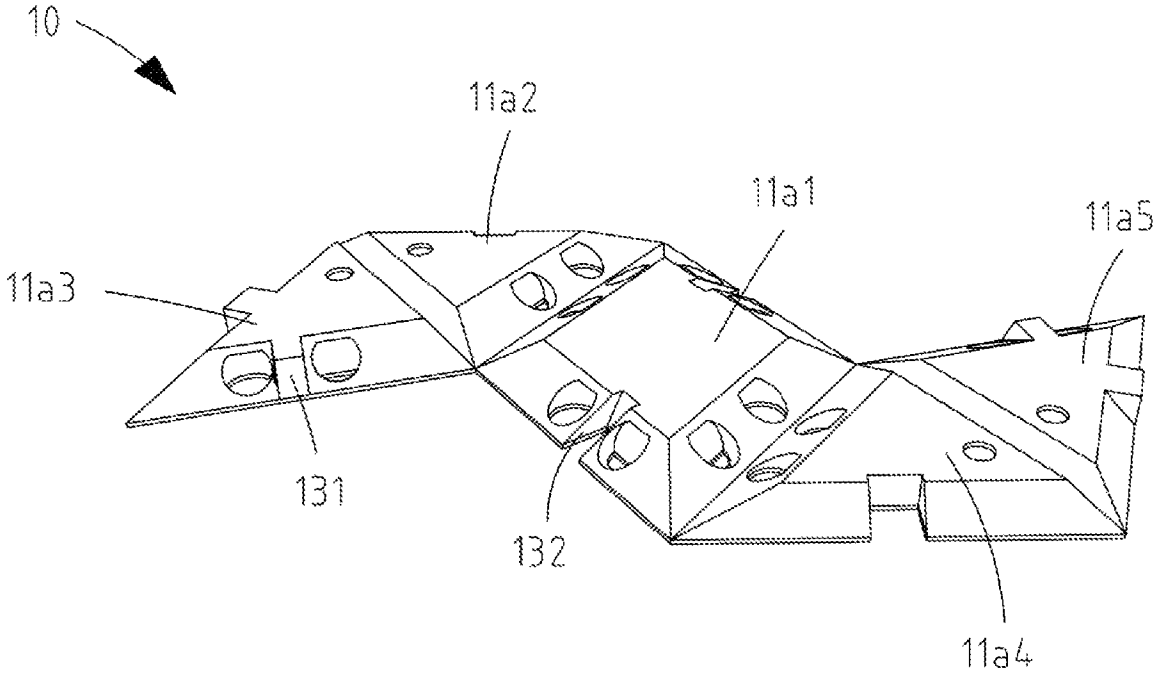
FIG. 4 is a schematic unfolding diagram of a first embodiment of an inner-layer assembly of the present disclosure.
Figure 9:
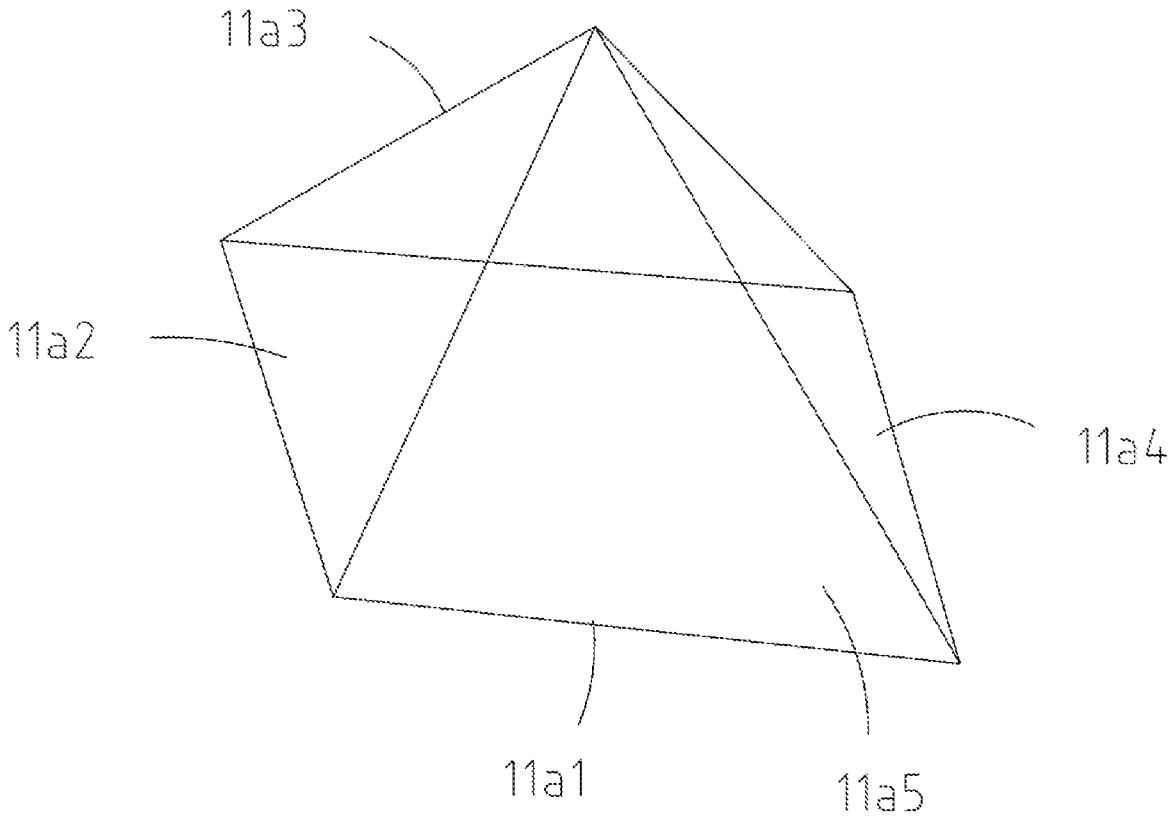
FIG. 9 is a schematic diagram of a polyhedral magnetic toy brick of a tetrapyramid the present disclosure.

The polyhedral magnetic toy brick is a tetrapyramid. Referring to FIG. 4 and FIG. 9, there are five board bodies 11, including a first board body 11*a*1, a second board body 11*a*2, a third board body 11*a*3, a fourth board body 11*a*4, and a fifth board body 11*a*5. The first board body 11*a*1 is rhombic. The second board body 11*a*2, the third board body 11*a*3, the fourth board body 11*a*4, and the fifth board body 11*a*5 are triangular. The second board body 11*a*2, the third board body 11*a*3, the fourth board body 11*a*4, and the fifth board body 11*a*5 are correspondingly connected to four edges of the rhombus of the first board body 11*a*1 respectively, and the second board body 11*a*2, the third board body 11*a*3, the fourth board body 11*a*4, and the fifth board body 11*a*5 are connected in sequence.

The first board body 11*a*1, the second board body 11*a*2, the third board body 11*a*3, the fourth board body 11*a*4, and the fifth board body 11*a*5 can be injected into a whole by upper and lower groups of molds, to achieve an unfolded state as shown in FIG. 4, and are then folded by plugging.

Specifically, the first board body 11*a*1, the second board body 11*a*2, the third board body 11*a*3, the fourth board body 11*a*4, and the fifth board body 11*a*5 are integrated and connected in a manner of aligning edges, to achieve mutual rotation. The second board body 11*a*2 and the fourth board body 11*a*4 are rotatably connected to two opposite edges of the first board body 11*a*1 respectively. The third board body 11*a*3 and the fifth board body 11*a*5 are plugged to the other two opposite edges of the first board body 11*a*1. Furthermore, the third board body 11*a*3 is rotatably connected to the second board body 11*a*2. The fifth board body 11*a*5 is rotatably connected to the fourth board body 11*a*4. The third board body 11*a*3 and the fourth board body 11*a*4, as well as the second board body 11*a*2 and the fifth board body 11*a*5, are plugged, so as to fold the board bodies to form the tetrapyramid as shown in FIG. 9.

An example in which the third board body 11*a*3 and the first board body 11*a*1 are plugged is taken for description. Referring to FIG. 4, the third board body 11*a*3 is provided with a plugging bar 131, and the first board body 11*a*1 is provided with a slot 132. The plugging bar 131 is plugged into the slot 132 to achieve plugging of the two board bodies.

The inner-layer assembly 10 is formed by splicing the several board bodies 11, so that the inner-layer assembly 10 is of a hollow structure. In this way, the cost can be reduced, and the toy brick has the characteristic of light weight.

The polyhedral magnetic toy brick which is the tetrapyramid includes five board bodies 11, four of which are triangular and one of which is rhombic. Therefore, the polyhedral magnetic toy brick includes 12 magnets 20.

Second Embodiment

Figure 5:
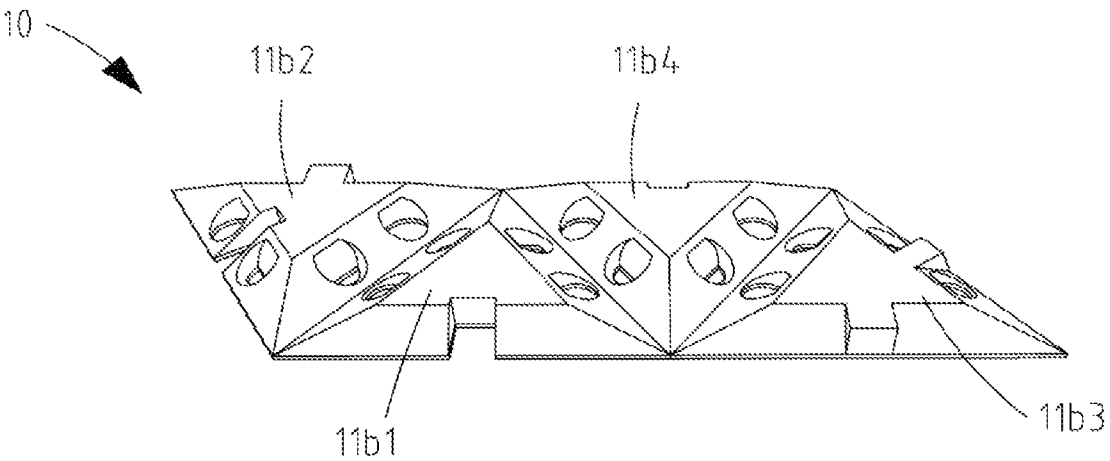
FIG. 5 is a schematic unfolding diagram of a second embodiment of an inner-layer assembly of the present disclosure.
Figure 10:
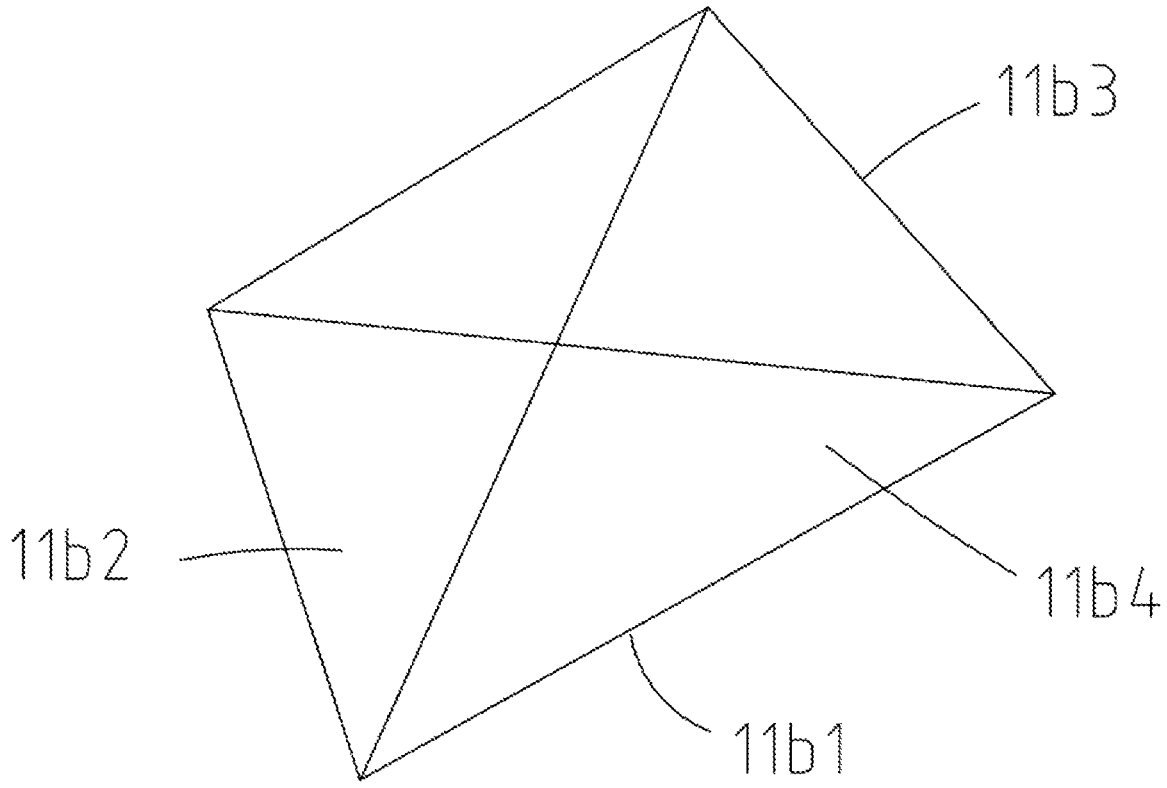
FIG. 10 is a schematic diagram of a polyhedral magnetic toy brick of a triangular pyramid the present disclosure.

The polyhedral magnetic toy brick is a triangular pyramid. Referring to FIG. 5 and FIG. 10, there are four board bodies 11, including a first board body 11*b*1, a second board body 11*b*2, a third board body 11*b*3, and a fourth board body 11*b*4. The first board body 11*b*1, the second board body 11*b*2, the third board body 11*b*3, and the fourth board body 11*b*4 are triangular. The second board body 11*b*2, the third board body 11*b*3, and the fourth board body 11*b*4 are correspondingly connected to three edges of the triangle of the first board body 11*b*1 respectively. The second board body 11*b*2, the third board body 11*b*3, and the fourth board body 11*b*4 are connected in sequence.

The second board body 11*b*2 and the fourth board body 11*b*4 are rotatably connected to two edges of the first board body 11*b*1, and the third board body 11*b*3 is plugged to the other edge of the first board body 11*b*1. The third board body 11*b*3 is rotatably connected to the fourth board body 11*b*4. Furthermore, the second board body 11*b*2 and the fourth board body 11*b*4, as well as the second board body 11*b*2 and the third board body 11*b*3, are also plugged, so as to fold the board bodies to form the triangular pyramid as shown in FIG. 10.

The polyhedral magnetic toy brick which is the triangular pyramid includes four board bodies 11, each of which is triangular. Therefore, the polyhedral magnetic toy brick includes eight magnets 20.

Third Embodiment

Figure 6:
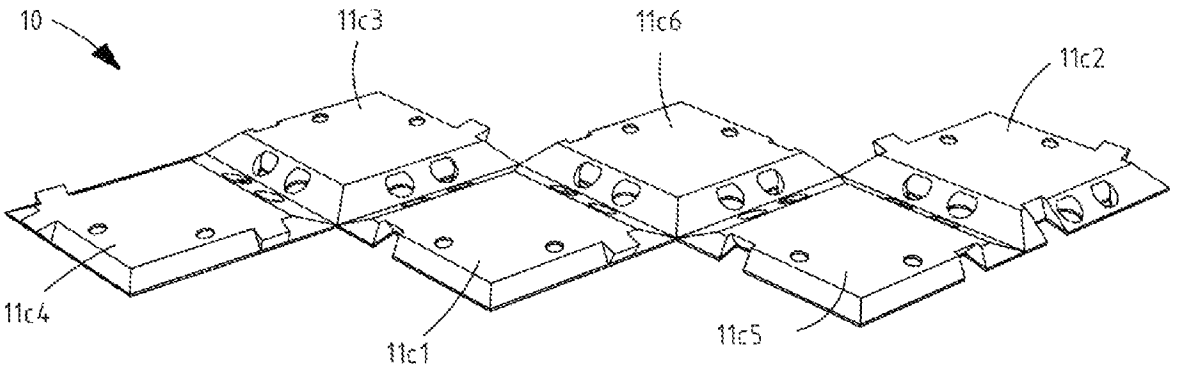
FIG. 6 is a schematic unfolding diagram of a third embodiment of an inner-layer assembly of the present disclosure.
Figure 11:
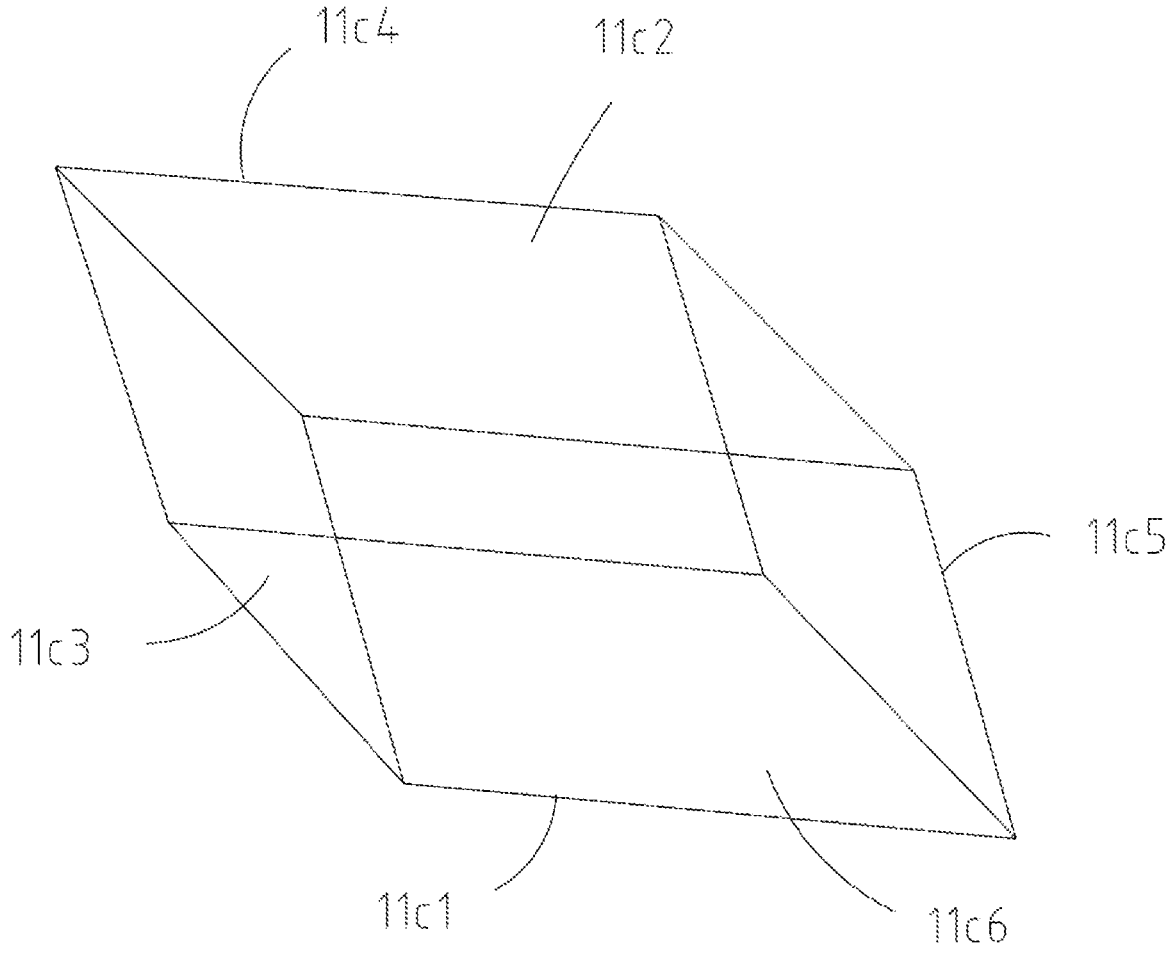
FIG. 11 is a schematic diagram of a polyhedral magnetic toy brick of an oblique quadrangular prism of the present disclosure.

The polyhedral magnetic toy brick is an oblique quadrangular prism. Referring to FIG. 6 and FIG. 11, there are six board bodies 11, including a first board body 11*c*1, a second board body 11*c*2, a third board body 11*c*3, a fourth board body 11*c*4, a fifth board body 11*c*5, and a sixth board body 11*c*6. The first board body 11*c*1, the second board body 11*c*2, the third board body 11*c*3, the fourth board body 11*c*4, the fifth board body 11*c*5, and the sixth board body 11*c*6 are all rhombic. The first board body 11*c*1 and the second board body 11*c*2 are diagonally opposite to each other. The third board body 11*c*3, the fourth board body 11*c*4, the fifth board body 11*c*5, and the sixth board body 11*c*6 are respectively connected between the first board body 11*c*1 and the second board body 11*c*2, and separately correspond to the four edges of the rhombuses of the first board body 11*c*1 and the second board body 11*c*2 respectively.

The third board body 11*c*3 and the sixth board body 11*c*6 are rotatably connected to two adjacent edges of the first board body 11*c*1. The fourth board body 11*c*4 and the fifth board body 11*c*5 are plugged to the other two adjacent edges of the first board body 11*c*1. The fourth board body 11*c*4 and the third board body 11*c*3, the fifth board body 11*c*5 and the sixth board body 11*c*6, as well as the second board body 11*c*2 and the fifth board body 11*c*5 are also rotatably connected. The fourth board body 11*c*4 and the fifth board body 11*c*5, as well as the third board body 11*c*3 and the sixth board body 11*c*6, are plugged. In addition, the second board body 11*c*2 is also plugged to the third board body 11*c*3, the fourth board body 11*c*4, and the sixth board body 11*c*6 respectively, so as to fold the board bodies to form the oblique quadrangular prism as shown in FIG. 11.

The polyhedral magnetic toy brick which is the oblique quadrangular prism includes six board bodies 11 which are all rhombic. Therefore, the polyhedral magnetic toy brick includes 24 magnets 20.

Fourth Embodiment

Figure 7:
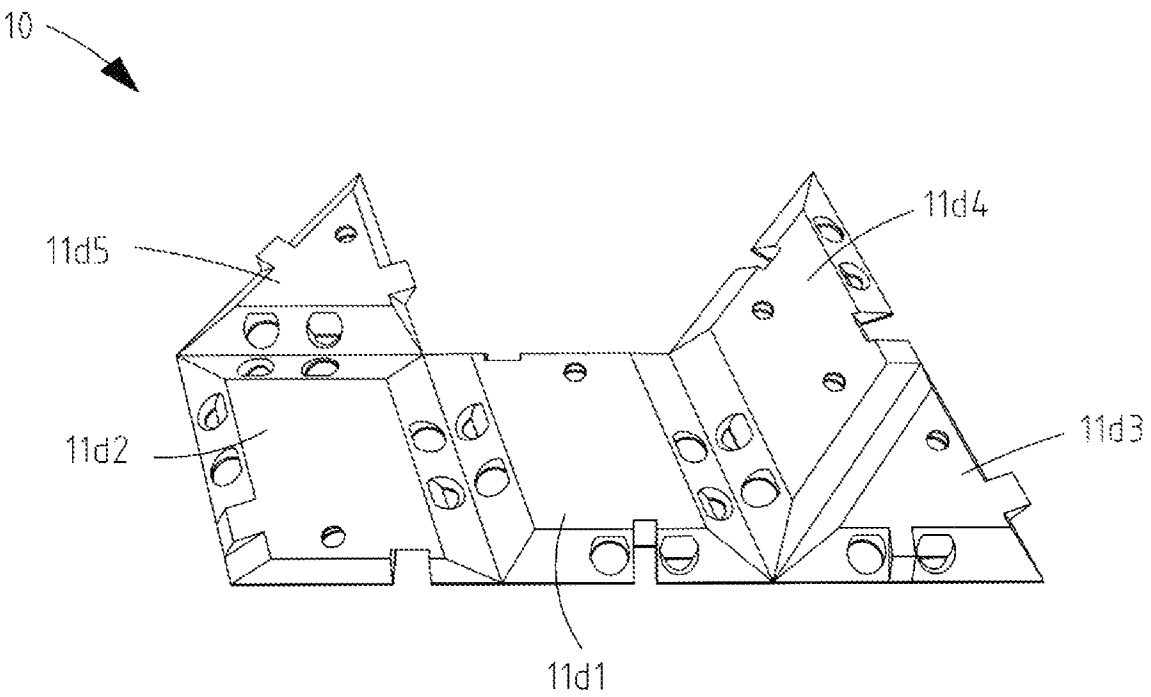
FIG. 7 is a schematic unfolding diagram of a fourth embodiment of an inner-layer assembly of the present disclosure.
Figure 12:
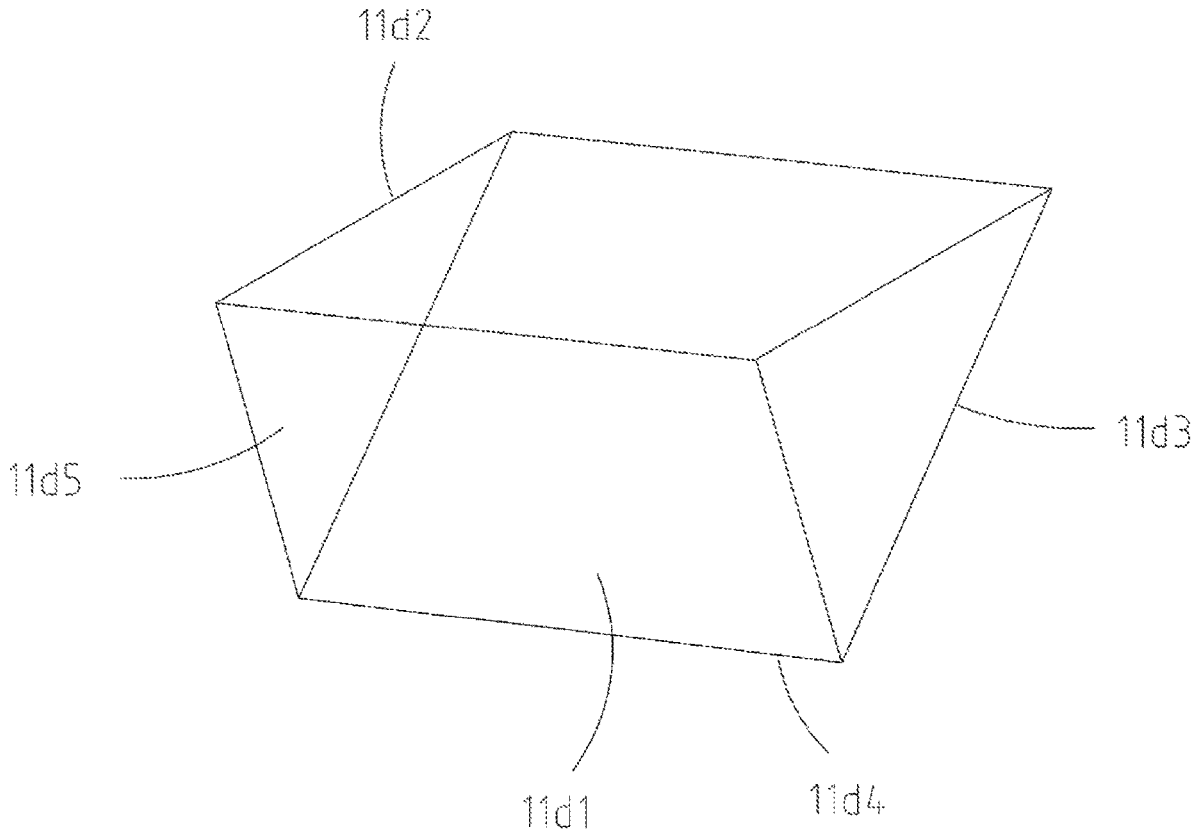
FIG. 12 is a schematic diagram of a polyhedral magnetic toy brick of an oblique triangular prism of the present disclosure.

The polyhedral magnetic toy brick is an oblique triangular prism. Referring to FIG. 7 and FIG. 12, there are five board bodies 11, including a first board body 11*d*1, a second board body 11*d*2, a third board body 11*d*3, a fourth board body 11*d*4, and a fifth board body 11*d*5. The first board body 11*d*1, the second board body 11*d*2, and the fourth board body 11*d*4 are rhombic, and the third board body 11*d*3 and the fifth board body 11*d*5 are triangular. The second board body 11*d*2, the third board body 11*d*3, the fourth board body 11*d*4, and the fifth board body 11*d*5 are correspondingly connected to the four edges of the rhombus of the first board body 11*d*1 respectively. The second board body 11*d*2 and the fourth board body 11*d*4 are opposite. The third board body 11*d*3 and the fifth board body 11*d*5 are opposite. Furthermore, the second board body 11*d*2, the third board body 11*d*3, the fourth board body 11*d*4, and the fifth board body 11*d*5 are connected in sequence.

The second board body 11*d*2 and the fourth board body 11*d*4 are rotatably connected to the two longer opposite edges of the first board body 11*d*1. The fifth board body 11*d*5 and the third board body 11*d*3 are plugged to the two shorter opposite edges of the first board body 11*d*1. The fifth board body 11*d*5 is rotatably connected to the second board body 11*d*2. The third board body 11*d*3 is integrated on the fourth board body 11*d*4. The fifth board body 11*d*5 and the fourth board body 11*d*4, the second board body 11*d*2 and the third board body 11*d*3, as well as the second board body 11*d*2 and the fourth board body 11*d*4, are plugged, so as to fold the board bodies to form the triangular prism as shown in FIG. 12.

The polyhedral magnetic toy brick which is the oblique triangular prism includes five board bodies 11, two of which are triangular and three of which is rhombic. Therefore, the polyhedral magnetic toy brick includes 16 magnets 20.

Fifth Embodiment

Figure 8:
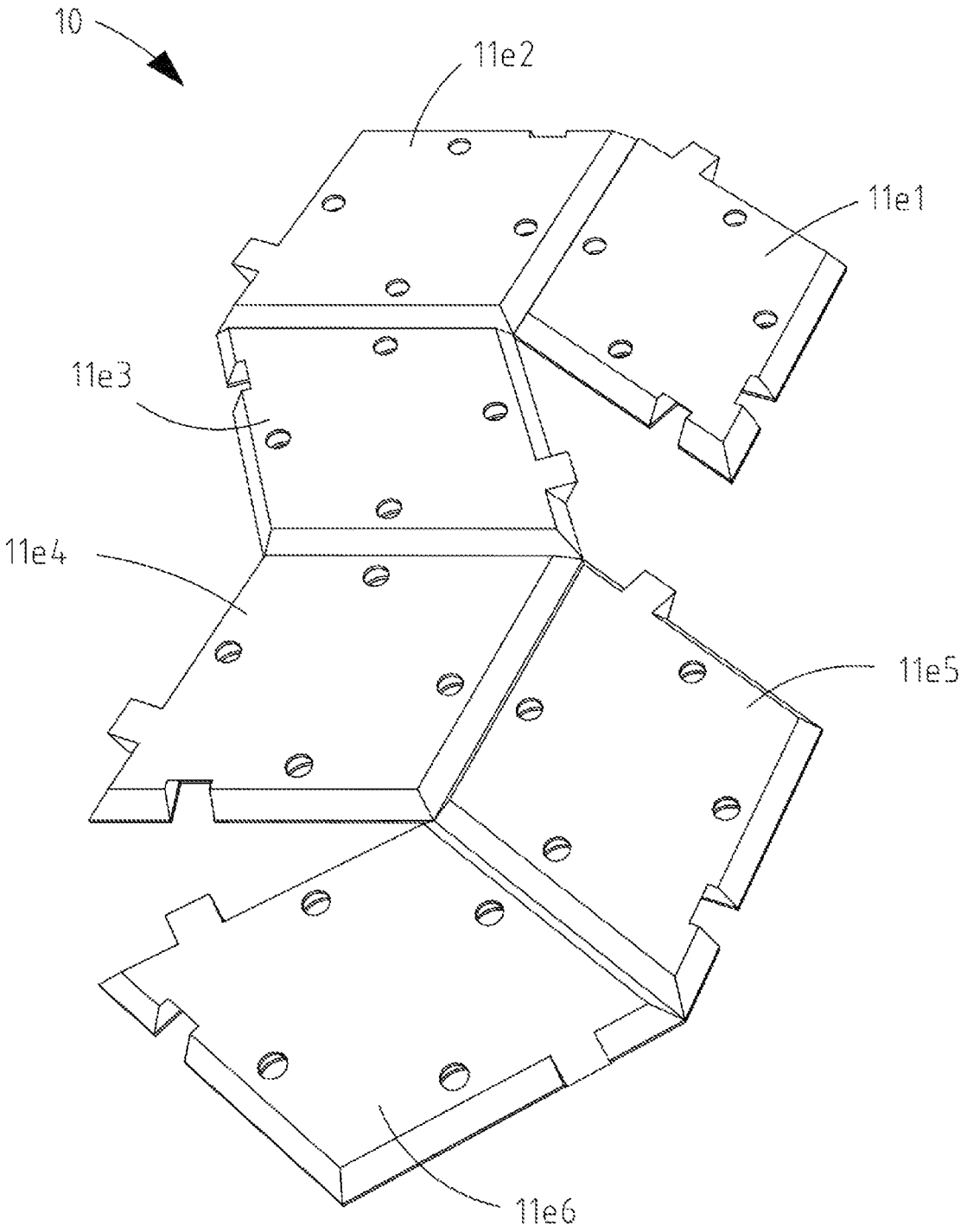
FIG. 8 is a schematic unfolding diagram of a fifth embodiment of an inner-layer assembly of the present disclosure.
Figure 13:
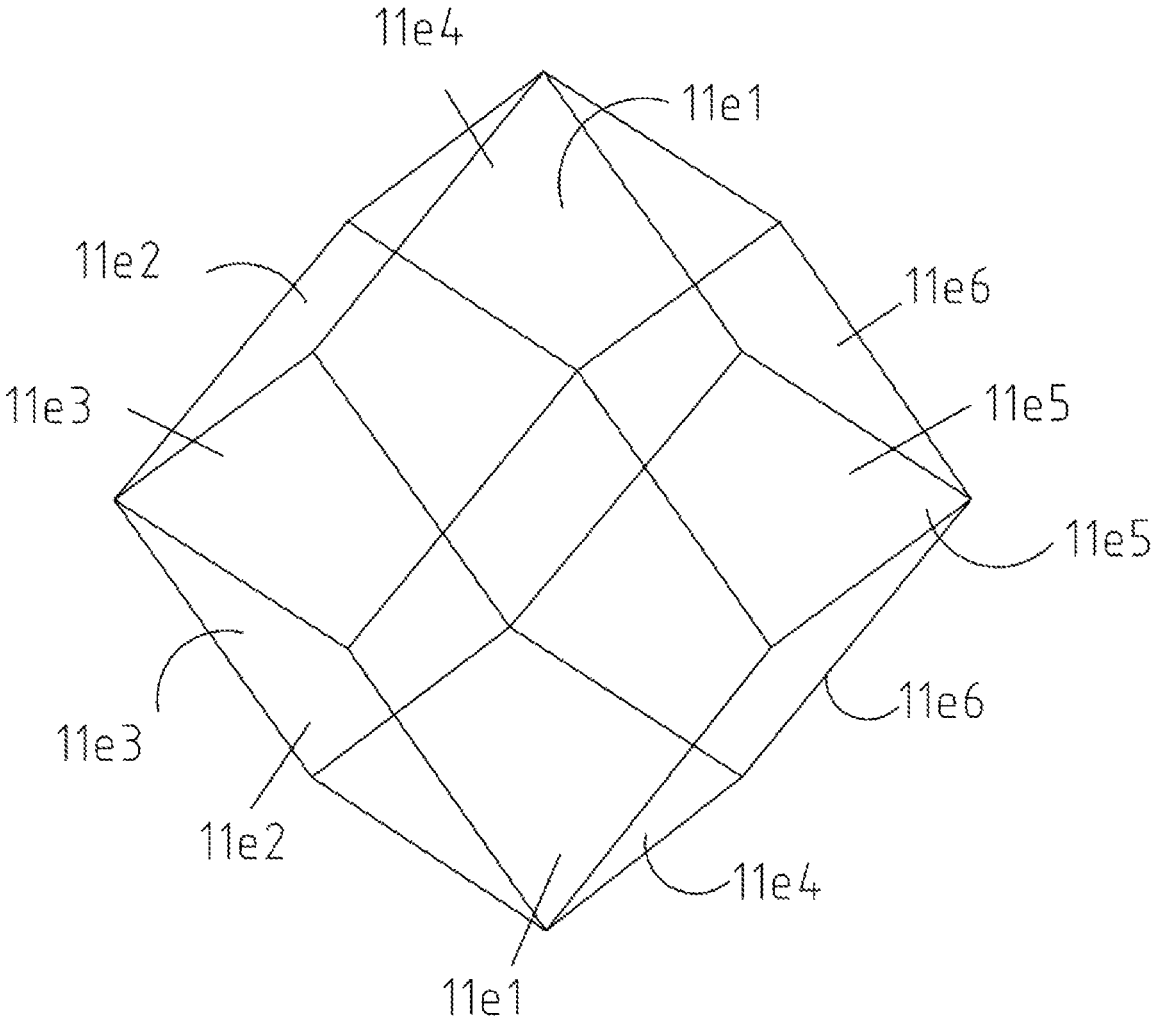
FIG. 13 is a schematic diagram of a triangular prism polyhedral magnetic toy brick of a rhombic regular dodecahedron of the present disclosure.

The polyhedral magnetic toy brick is a rhombic regular dodecahedron. Referring to FIG. 8 and FIG. 13, the inner-layer assembly 10 is formed by connecting two groups of the board bodies 11. There are six board bodies 11 in each group, namely, a first board body 11*e*1, a second board body 11*e*2, a third board body 11*e*3, a fourth board body 11*e*4, a fifth board body 11*e*5, and a sixth board body 11*e*6. The first board body 11*e*1, the second board body 11*e*2, the third board body 11*e*3, the fourth board body 11*e*4, the fifth board body 11*e*5, and the sixth board body 11*e*6 are rhombic.

Two adjacent edges of the first board body 11*e*1 are respectively plugged to the third board body 11*e*3 and the fifth board body 11*e*5. Another edge of the first board body 11*e*1 is rotatably connected to the second board body 11*e*2. The second board body 11*e*2 is rotatably connected to the third board body 11*e*3. The fourth board body 11*e*4 is rotatably connected between the third board body 11*e*3 and the fifth board body 11*e*5. The sixth board body 11*e*6 and the fifth board body 11*e*5 are rotatably connected. The sixth board body 11*e*6 and the fourth board body 11*e*4 are plugged.

Referring to FIG. 13, the two groups of board bodies 11 include a first group and a second group. When the first group is connected to the second group, the second board body 11*e*2 of the first group is plugged to the third board body 11*e*3 and the fourth board body 11*e*4 of the second group. The third board body 11*e*3 of the first group is plugged to the second board body 11*e*2 of the second group. The fourth board body 11*e*4 of the first group is plugged to the second board body 11*e*2 of the second group. The fifth board body 11*e*5 of the first group is plugged to the sixth board body 11*e*6 of the second group. The sixth board body 11*e*6 of the first group is plugged to the first board body 11*e*1 and the fifth board body 11*e*5 of the second group respectively, so as to fold the board bodies to form the rhombic regular dodecahedron as shown in FIG. 13.

The polyhedral magnetic toy brick which is the rhombic regular dodecahedron includes 12 board bodies 11 which are all rhombic. Therefore, the polyhedral magnetic toy brick includes 48 magnets 20.

From the above embodiments, it can be seen that the board bodies 11 constituting the inner-layer assembly 10 may be the same or different in shape. In this way, the board bodies can be folded to form the polyhedral magnetic toy bricks with different shapes, which provides more possibilities for construction of combined models. In addition, the board bodies 11 constituting the inner-layer assembly 10 can be integrally molded and are then plugged. Two adjacent board bodies 11 that are integrally molded can rotate each other, which reduces the assembling difficulty and ensures the manufacturability. In addition to the above shapes, the polyhedral magnetic toy bricks can also be made into different shapes by adjusting the quantity, shapes, and sizes of the board bodies 11.

In conclusion, the inner-layer assembly 10 is formed by splicing the several board bodies 11, and the outer skin assembly wraps the outer surface of the inner-layer assembly 10, so that the polyhedral magnetic toy brick with good structural strength and stability can be formed. Furthermore, the magnet mounting holes 12 for accommodating the magnets 20 are formed in the magnetic face 100 of the board body 11, so that the magnets 20 can be stably fixed on the board body 11 and is avoided from being separated or moving relative to the board body 11, and magnetic connection between the toy bricks can be guaranteed; and different models can be combined. In addition, the same magnetic face 100 has two magnets 20 with opposite outward magnetisms. In this way, when two toy bricks are connected, the N-pole magnet on one magnetic face 100 is in magnetic fit with the S-pole magnet on the other magnetic face 100, that is, the two magnetic faces 100 are magnetically connected through the two groups of N and S-pole magnets, which ensures that the vertexes, the edges, and the faces of the two magnetic faces 100 are kept in completely overlapping under the magnetic action, so that inconvenience in modeling and combination processes caused by turning, sliding, or other phenomena in a combination process is avoided. In addition, the board bodies 11 constituting the inner-layer assembly 10 can be integrally molded and are then fixed by plugging, which reduces the assembling difficulty and ensures the manufacturability.

The present disclosure further provides a combined structure, including at least two polyhedral magnetic toy bricks of any of the above embodiments. The two polyhedral magnetic toy bricks are connected through the magnetic faces 100.

Since the combined structure adopts the polyhedral magnetic toy bricks of the above embodiment, the beneficial effects of the combined structure can refer to the beneficial effects of the polyhedral magnetic toy bricks of the above embodiment.

Furthermore, the combined structure can be constructed by the polyhedral magnetic toy bricks with different or same shapes, and can be magnetically connected through the board bodies 11 with different shapes. In this way, the possibility of constructing models can be effectively increased. When two board bodies 11 with different shapes are magnetically connected, since the board bodies 11 take the magnetic faces 100 as a unit, the two magnetically connected board bodies 11 can be magnetically connected through the magnetic faces 100. The N-pole magnet on one magnetic face 100 is in magnetic fit with the S-pole magnet of the other magnetic face 100. That is, the two magnetic faces 100 are magnetically connected through the two groups of N and S-pole magnets, so that it is ensured that the two magnetic faces 100 are aligned, which ensures that the board bodies 11 with different shapes can be constructed stably and further achieves the diversification of constructing models.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A Polyhedral magnetic toy brick, comprising:

an inner-layer assembly, wherein the inner-layer assembly comprises several board bodies; the several board bodies are folded to form the inner-layer assembly; the board bodies comprise at least one triangular magnetic face; two magnet mounting holes are formed in the magnetic face;

at least two magnets, wherein one magnet is mounted in each magnet mounting hole, and the two magnets on the same magnetic face have opposite outward magnetisms.

2. The polyhedral magnetic toy brick according to claim 1, wherein the magnetic faces are outer faces of the board bodies; when there is one magnetic face, the board body defined by the magnetic face is triangular; and when there are two magnetic faces, the board body defined by the two magnetic faces is rhombic or square.

3. The polyhedral magnetic toy brick according to claim 1, wherein the two magnets are symmetrically arranged along a center line of the triangular magnetic face.

4. The polyhedral magnetic toy brick according to claim 1, wherein each polyhedral magnetic toy brick is a tetrapyramid including five board bodies, namely, a first board body, a second board body, a third board body, a fourth board body, and a fifth board body; the first board body is rhombic; the second board body, the third board body, the fourth board body, and the fifth board body are triangular;

the second board body and the fourth board body are rotatably connected to two opposite edges of the first board body; the third board body and the fifth board body are plugged to the other two opposite edges of the first board body; the third board body and the second board body, as well as the fourth board body and the fifth board body, are rotatably connected; and the second board body and the fifth board body, as well as the third board body and the fourth board body, are plugged.

5. The polyhedral magnetic toy brick according to claim 1, wherein each polyhedral magnetic toy brick is a triangular pyramid including four board bodies, namely, a first board body, a second board body, a third board body, a fourth board body, and a fifth board body; the first board body, the second board body, the third board body, and the fourth board body are triangular;

the second board body and the fourth board body are rotatably connected to two edges of the first board body; the third board body is plugged to the other edge of the first board body; the third board body and the fourth board body are rotatably connected; and the second board body and the fourth board body, as well as the third board body and the second board body, are plugged.

6. The polyhedral magnetic toy brick according to claim 1, wherein each polyhedral magnetic toy brick is an oblique quadrangular prism including sixth board bodies, namely, a first board body, a second board body, a third board body, a fourth board body, a fifth board body, and a sixth board body; the first board body, the second board body, the third board body, the fourth board body, the fifth board body, and the six board body are rhombic;

the third board body and the sixth board body are rotatably connected to two adjacent edges of the first board body; the fourth board body and the fifth board body are plugged to the other two adjacent edges of the first board body; the third board body and the sixth board body, as well as the fourth board body and the fifth board body are plugged; the second board body and the first board body are parallel; the second board body and the fifth board body are rotatably connected; and the second board body and the third board body, as well as the fourth board body and the sixth board body are plugged.

7. The polyhedral magnetic toy brick according to claim 1, wherein each polyhedral magnetic toy brick is an oblique triangular prism including five board bodies, namely, a first board body, a second board body, a third board body, a fourth board body, and a fifth board body; the first board body, the second board body, and the fourth board body are rhombic; the third board body and the fifth board body are triangular;

the second board body and the fourth board body are rotatably connected to two opposite edges of the first board body; the fifth board body and the third board body are plugged to the other two opposite edges of the first board body; the fifth board body and the second board body, as well as the third board body and the fourth board body, are rotatably connected; and the fourth board body and the fifth board body, the third board body and the second board body, as well as the second board body and the fourth board body, are plugged.

8. The polyhedral magnetic toy brick according to claim 1, wherein each polyhedral magnetic toy brick is a rhombic regular dodecahedron; the inner-layer assembly is formed by connecting two groups of the board bodies; there are six board bodies in each group, namely, a first board body, a second board body, a third board body, a fourth board body, a fifth board body, and a sixth board body; the first board body, the second board body, the third board body, the fourth board body, the fifth board body, and the sixth board body are rhombic;

two adjacent edges of the first board body are respectively plugged to the third board body and the fifth board body; another edge of the first board body is rotatably connected with the second board body; the second board body and the third board body are rotatably connected; the fourth board body is rotatably connected between the third board body and the fifth board body; the sixth board body and the fifth board body are rotatably connected; and the sixth board body and the fourth board body are plugged.

9. The polyhedral magnetic toy brick according to claim 1, wherein the several board bodies are integrally molded, and are folded and fixed by plugging.

10. A combined structure, comprising two polyhedral magnetic toy bricks, each of the polyhedral magnetic toy bricks comprising:

an inner-layer assembly, wherein the inner-layer assembly comprises several board bodies; the several board bodies are folded to form the inner-layer assembly; the board bodies comprise at least one triangular magnetic face; two magnet mounting holes are formed in the magnetic face;

at least two magnets, wherein one magnet is mounted in each magnet mounting hole, and the two magnets on the same magnetic face have opposite outward magnetisms;

wherein two of the polyhedral magnetic toy bricks are connected through the magnetic faces.

11. The combined structure according to claim 10, wherein the magnetic faces are outer faces of the board bodies; when there is one magnetic face, the board body defined by the magnetic face is triangular; and when there are two magnetic faces, the board body defined by the two magnetic faces is rhombic or square.

12. The combined structure according to claim 10, wherein the two magnets are symmetrically arranged along a center line of the triangular magnetic face.

13. The combined structure according to claim 10, wherein each polyhedral magnetic toy brick is a tetrapyramid including five board bodies, namely, a first board body, a second board body, a third board body, a fourth board body, and a fifth board body; the first board body is rhombic; the second board body, the third board body, the fourth board body, and the fifth board body are triangular;

the second board body and the fourth board body are rotatably connected to two opposite edges of the first board body; the third board body and the fifth board body are plugged to the other two opposite edges of the first board body; the third board body and the second board body, as well as the fourth board body and the fifth board body, are rotatably connected; and the second board body and the fifth board body, as well as the third board body and the fourth board body, are plugged.

14. The combined structure according to claim 10, wherein each polyhedral magnetic toy brick is a triangular pyramid including four board bodies, namely, a first board body, a second board body, a third board body, a fourth board body, and a fifth board body; the first board body, the second board body, the third board body, and the fourth board body are triangular;

the second board body and the fourth board body are rotatably connected to two edges of the first board body; the third board body is plugged to the other edge of the first board body; the third board body and the fourth board body are rotatably connected; and the second board body and the fourth board body, as well as the third board body and the second board body, are plugged.

15. The combined structure according to claim 10, wherein each polyhedral magnetic toy brick is an oblique quadrangular prism including sixth board bodies, namely, a first board body, a second board body, a third board body, a fourth board body, a fifth board body, and a sixth board body; the first board body, the second board body, the third board body, the fourth board body, the fifth board body, and the six board body are rhombic;

the third board body and the sixth board body are rotatably connected to two adjacent edges of the first board body; the fourth board body and the fifth board body are plugged to the other two adjacent edges of the first board body; the third board body and the sixth board body, as well as the fourth board body and the fifth board body are plugged; the second board body and the first board body are parallel; the second board body and the fifth board body are rotatably connected; and the second board body and the third board body, as well as the fourth board body and the sixth board body are plugged.

16. The combined structure according to claim 10, wherein each polyhedral magnetic toy brick is an oblique triangular prism including five board bodies, namely, a first board body, a second board body, a third board body, a fourth board body, and a fifth board body; the first board body, the second board body, and the fourth board body are rhombic; the third board body and the fifth board body are triangular;

the second board body and the fourth board body are rotatably connected to two opposite edges of the first board body; the fifth board body and the third board body are plugged to the other two opposite edges of the first board body; the fifth board body and the second board body, as well as the third board body and the fourth board body, are rotatably connected; and the fourth board body and the fifth board body, the third board body and the second board body, as well as the second board body and the fourth board body, are plugged.

17. The combined structure according to claim 10, wherein each polyhedral magnetic toy brick is a rhombic regular dodecahedron; the inner-layer assembly is formed by connecting two groups of the board bodies; there are six board bodies in each group, namely, a first board body, a second board body, a third board body, a fourth board body, a fifth board body, and a sixth board body; the first board body, the second board body, the third board body, the fourth board body, the fifth board body, and the sixth board body are rhombic;

two adjacent edges of the first board body are respectively plugged to the third board body and the fifth board body; another edge of the first board body is rotatably connected with the second board body; the second board body and the third board body are rotatably connected; the fourth board body is rotatably connected between the third board body and the fifth board body; the sixth board body and the fifth board body are rotatably connected; and the sixth board body and the fourth board body are plugged.

18. The combined structure according to claim 10, wherein the several board bodies are integrally molded, and are folded and fixed by plugging.

* * * * *